US005405146A

United States Patent [19]

Washington

[11] Patent Number: 5,405,146

[45] Date of Patent: Apr. 11, 1995

[54] FRAME KIT FOR PICTURE PUZZLE ASSEMBLY

[76] Inventor: Mary Washington, 2019 W. George St., Philadelphia, Pa. 19130

[21] Appl. No.: 260,302

[22] Filed: Jun. 15, 1994

[51] Int. Cl.[6] ..... A63F 9/10; A47G 1/10

[52] U.S. Cl. ..... 273/157 R; 273/309; 40/152; 40/155

[58] Field of Search ..... 273/153 R, 157 R, 148 R, 273/309; 434/365, 406; 40/1, 152, 152.1, 155, 156, 157, 158.1, 159.2

[56] References Cited

U.S. PATENT DOCUMENTS

| | | | |
|---|---|---|---|
| D. 298,149 | 10/1988 | Hermans et al. . | |
| D. 335,152 | 4/1993 | Hollrah . | |
| 3,504,915 | 4/1970 | Walker . | |
| 3,673,722 | 7/1972 | Robertson | 40/152 |
| 3,783,543 | 1/1974 | Hemgren | 40/152 |
| 4,053,159 | 10/1977 | Kolak | 40/152 |
| 4,111,425 | 9/1978 | Lathrop . | |
| 4,637,147 | 1/1987 | Wolsey | 40/152 |
| 4,672,758 | 6/1987 | Le-Carpentier et al. | 40/152.1 |
| 4,761,903 | 8/1988 | Cantrell | 40/152 |
| 4,777,746 | 10/1988 | Brooks | 40/152.1 |
| 4,792,138 | 12/1988 | Watkins | 273/148 R |
| 4,947,566 | 8/1990 | Hoebel | 40/152.1 |
| 4,998,363 | 3/1991 | Vilims . | |
| 5,158,295 | 10/1992 | Shilling | 273/157 R |
| 5,219,168 | 6/1993 | Morris . | |
| 5,243,777 | 9/1993 | Dedlow | 40/152.1 |
| 5,283,967 | 2/1994 | Abrams | 40/152 |

FOREIGN PATENT DOCUMENTS

| | | |
|---|---|---|
| 528751 | 3/1957 | Belgium . |
| 1183780 | 7/1959 | France . |

*Primary Examiner*—Vincent Millin
*Assistant Examiner*—William M. Pierce
*Attorney, Agent, or Firm*—Richard C. Zitman

[57] ABSTRACT

A frame kit for the temporary or permanent assembly of picture puzzles or the like therein, comprises a plurality of frame components and a backing panel which may be temporarily or permanently assembled together. The backing panel includes an adhesive side with a removable overlay sheet. The overlay sheet may be left in place for the temporary assembly and later disassembly of picture puzzles thereon, or may be removed to expose the adhesive to provide for the permanent assembly of such a puzzle thereon for permanent display within the frame. The frame components may be formed of a variety of different materials and may utilize different assembly techniques. The disassembly of the components, as well as the folding configuration of the backing panel, result in a relatively compact kit for storage purposes. The frame and backing panel may be provided in various sizes to closely match the various sizes of completed picture puzzles.

17 Claims, 2 Drawing Sheets

10
12a
12b
12c
12d
14
15
16
18
20
22a
22b
24a
24b
26
28
30
32
34

FRAME KIT FOR PICTURE PUZZLE ASSEMBLY

FIELD OF THE INVENTION

The present invention relates generally to picture frames and the like, and more specifically to a kit for a frame for the temporary or permanent assembly of jigsaw or picture puzzles therein.

BACKGROUND OF THE INVENTION

The assembly of picture puzzles formed of a multitude of randomly shaped interlocking pieces (also known as "jigsaw" puzzles) has become an increasingly popular pastime with many individuals. Generally such puzzles, particularly those of higher quality and/or containing a relatively large number of pieces, can form a very attractive picture when completed. Manufacturers of such puzzles generally attempt to provide such attractive pictures for their completed puzzles in order to entice the puzzle worker into purchasing that particular puzzle from the art supplied on the container, and also to encourage the puzzle worker to complete the puzzle.

In fact, in many cases the completed puzzle is worthy of display, but must be disassembled for storage, as the puzzle is generally assembled directly upon an existing table which must be cleared for other use once the puzzle has been completed. While some have attempted to provide some form of backing for such puzzles while under construction, they generally have been unsatisfactory due to their flexibility. Moreover, even if a satisfactory backing is provided, a frame must still be acquired to provide an attractive display.

The need arises for a frame kit providing for the temporary or permanent assembly of a picture puzzle therein. The kit must include peripheral frame members of the proper number and dimensions to closely match the periphery of the selected puzzle when it is completed, and a backing sheet providing selectably exposable adhesive means for the permanent assembly of a picture puzzle thereon. The frame members and backing must provide for ease of assembly of those components, using no more than a few simple hand tools, or adhesives or the like. Finally, the frame members must provide an attractive frame for display when the kit and puzzle have been completed together.

DESCRIPTION OF THE PRIOR ART

U.S. Pat. No. 3,504,915 issued to Robert J. Walker on Apr. 7, 1970 discloses a Puzzle Holder comprising two opposed, relatively rigid boards with cooperating fasteners, the arrangement providing for the sandwiching of a partially completed picture puzzle therebetween for storage between puzzle working periods. The holder includes a soft, resilient blanket or padding therein, which padding serves to tightly hold the puzzle pieces against the opposite board to preclude shifting thereof. The permanent assembly of a puzzle is disclosed, by inverting the assembly and removing the board adjacent to the back of the puzzle, and then applying an adhesive backing paper to the back of the puzzle. As noted above, the use of adhesive paper fails to provide sufficient rigidity for the permanent assembly of a multitude of small, coplanar puzzle pieces; an additional relatively stiff sheet would be required. Moreover, Walker fails to disclose any peripheral frame, either to facilitate puzzle assembly or for display.

U.S. Pat. No. 4,111,425 issued to George E. Lathrop on Sep. 5, 1978 discloses a Jigsaw Puzzle Holder And Display Apparatus comprising a single piece tray and board extending thereacross, with a single piece frame attachable thereto. As no means is provided for the breakdown or disassembly of the frame, tray, and board components. The arrangement is quite bulky and cumbersome, particularly when sized for large puzzles containing a relatively large number of pieces. A resilient, non-adhesive backing is provided, into which the puzzle pieces are collectively forced when a transparent cover sheet is applied thereover. The cover sheet is configured to apply pressure to the puzzle pieces to preclude their relative movement, but no adhesive is used.

U.S. Pat. No. 4,998,363 issued to Daniel E. Vilims on Mar. 12, 1991 discloses a Picture/Poster Frame Assembly and Retainer For Holding Components In The Frame Of The Assembly. A one piece frame and non-adhesive backing are provided, with a series of clips being adhesively secured to the backing and clipped to the edge of the frame. The non-adhesive nature of the backing is incapable of retaining a completed picture puzzle comprising a multitude of individual pieces, and no disclosure is made of any means for the disassembly of the frame, as in the present invention.

U.S. Pat. No. 5,219,168 issued to James E. Morris on Jun. 15, 1993 discloses a Puzzle Apparatus with at least one panel for storage of puzzle pieces and another adjoining panel for the assembly of the pieces. The means used for retaining the puzzle pieces on the panels requires some cooperative structure on each of the puzzle pieces (e.g., a magnetic backing), whereas the present invention may be used with a standard picture puzzle. Further, Morris does not disclose any frame or frame assembly.

U.S. Pat. No. D-298,149 issued to Albert Hermans et al. on Oct. 18, 1988 discloses a design for a Combined Puzzle And Holder Therefor, comprising a planar multiple piece puzzle in a book-like case. The case resembles those used for video cassettes, and does not appear to be disassembleable into separate components, as in the present invention. No adhesive backing is disclosed.

U.S. Pat. No. D-335,152 issued to Paul R. Hollrah on Apr. 27, 1993 discloses a design for a Holder For Jigsaw Puzzles in the form of a flat rectangular article. It appears as though latches or some connecting means are shown along at least one edge, indicating that the design is intended to be folded open from the disclosed configuration, unlike the present invention. No adhesive backing or frame are disclosed.

Belgian Patent No. 528,751 to G. Rutten and published on Mar. 29, 1957 discloses a folding rectangular container having beveled edges. One interior view discloses peripheral structure having the appearance of retainers for a planar article contained therein. The present invention does not include peripheral retaining means for the puzzle itself, but rather uses a frame channel to retain the backing. Rutten does not disclose any adhesive means.

Finally, French Patent No. 1,183,780 to Jean A. M. Menial and published on Jul. 13, 1959 discloses a holder for viewing photographic slides or transparencies. The slide is peripherally secured within a one piece peripheral frame by an overlying peripheral retainer. No backing or adhesive is disclosed; any backing would preclude viewing the transparency through the frame.

None of the above noted patents, taken either singly or in combination, are seen to disclose the specific arrangement of concepts disclosed by the present invention.

SUMMARY OF THE INVENTION

By the present invention, an improved frame kit providing for the temporary or permanent assembly of picture puzzles therein, is disclosed.

Accordingly, one of the objects of the present invention is to provide an improved picture puzzle frame kit which is easily assembleable or disassembleable for compact storage until needed.

Another of the objects of the present invention is to provide an improved picture puzzle frame kit which includes a relatively rigid backing sheet and means for the retention of the backing sheet within the frame assembly.

Yet another of the objects of the present invention is to provide an improved frame kit which frame components may be assembled in a variety of ways.

Still another of the objects of the present invention is to provide an improved frame kit which backing includes a removable overlay sheet to protect an adhesive layer, which overlay sheet may be left in place on the backing to allow a puzzle to be temporarily assembled on the backing, or which may be removed to allow the adhesive to permanently secure the puzzle pieces in place.

A further object of the present invention is to provide an improved frame kit which may be formed of a variety of different materials, including, wood, plastic, and metal.

An additional object of the present invention is to provide an improved frame kit which may be provided in different sizes, to provide frames closely matching the completed sizes of various puzzles.

A final object of the present invention is to provide an improved frame kit providing for the assembly of picture puzzles for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1:
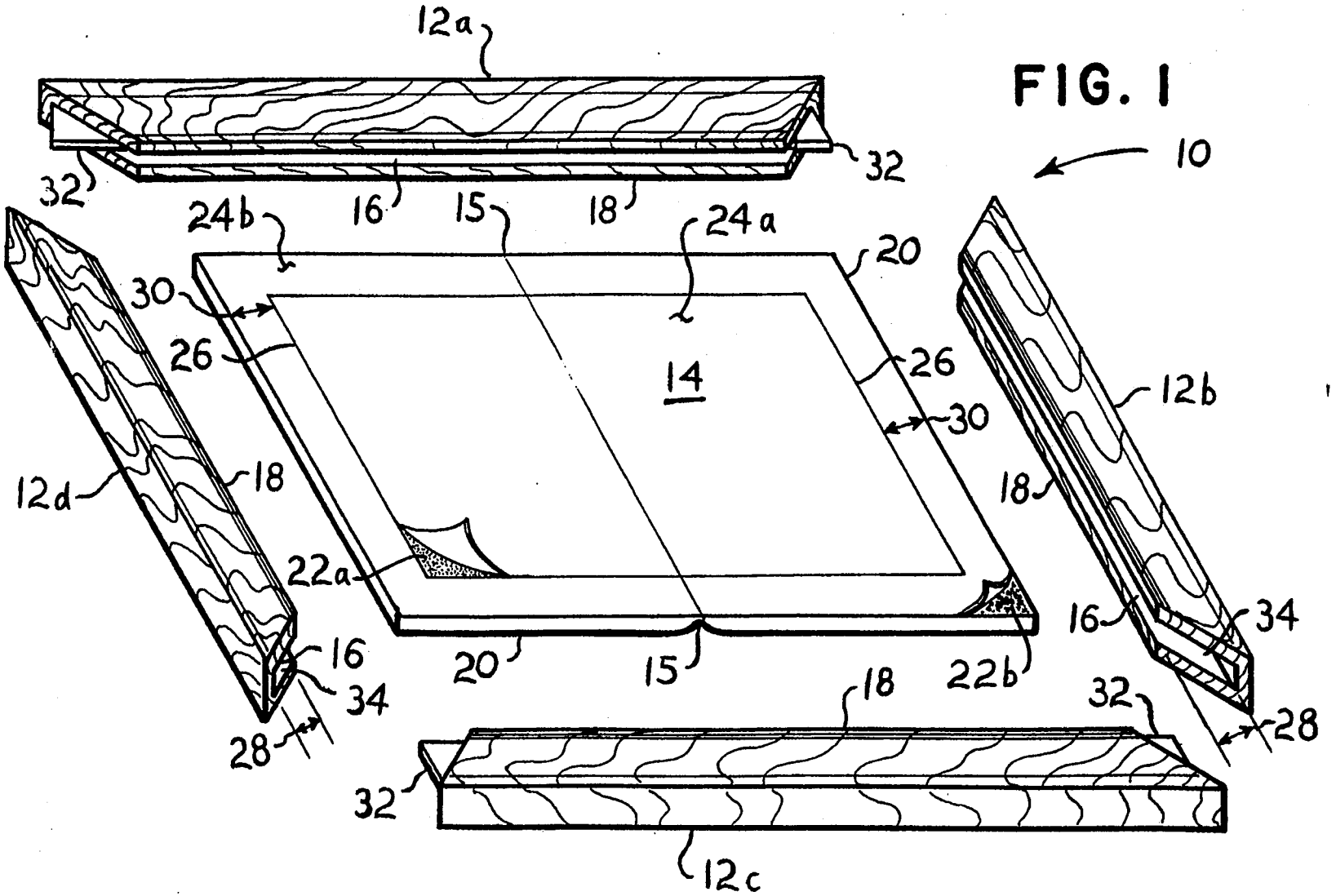
FIG. 1 is an exploded perspective view of the frame kit of the present invention, showing one configuration of the frame components and the backing panel with its adhesive and overlay sheet.

Referring now particularly to FIG. 1 of the drawings, the present invention will be seen to relate to a frame kit 10 providing for the temporary or permanent assembly of picture puzzles, jigsaw puzzles or the like therein.

Kit 10 generally comprises a plurality of frame components 12 (designated as 12*a* through 12*d* in FIG. 1) and a backing panel 14. (It should be noted that, while four frame members or components 12*a* through 12*d* are shown in FIG. 1 to form a rectangular frame, that more or fewer frame components may be provided in either straight or curved sections to provide frames of other geometric shapes.) The frame components 12*a* through 12*d* of FIG. 1 may have a generally rectangular cross section and may be formed of wood, as shown, or other sections and materials discussed below. Each of the frame components 12*a* through 12*d* includes a channel 16 formed continuously along an inner periphery 18 thereof, which channel 16 is adapted to cooperate with a periphery 20 of the backing panel 14 to form a completed assembly.

The backing panel 14 is preferably formed of a relatively stiff and rigid planar sheet of material, e.g., wood, metal, acrylic or other plastic or synthetic material having similar strength characteristics, etc. A crease or fold line 15 may be provided thereacross, to provide for folding of the panel 14 for compact storage, if desired. At least one of the two surfaces thereof may be provided with an adhesive coating 22 (which may be divided into a central area 22*a* covering the substantial majority of the panel 14, and a border area 22*b*). The adhesive coating 22 may be protected until use by a removable overlay sheet 24 (which may be divided into a first or central sheet 24*a* and a second or border sheet 24*b*, respectively covering adhesive areas 22*a* and 22*b*). A score line 26 may be provided between the central overlay sheet 24*a* and the border overlay sheet 24*b* to allow the independent removal of each sheet 24*a* or 24*b*, as desired. Alternatively, the overlay sheet 24 may be provided as a single, continuous sheet.

The channels 16 of each of the frame members 12 will be seen to have a depth 28 which is substantially equal to a width of the border area 30, defined by the width of the border overlay sheet 24*b*. Accordingly, the frame members 12 may be installed about the periphery 20 of the backing panel 14 by inserting the border area 30 of the panel 14 within the channels 16 of the frame components 12, while still leaving the entire central overlay sheet 24*a* and the score line 30 accessible for ease of removal of the central overlay sheet 24*a*, if desired. Alternatively, the border overlay sheet 24*b* may be removed to expose the adhesive coating 22*b* thereunder, which coating 22*b* may provide for the adhesive assembly of the frame members 12*a* through 12*d* to the backing panel 14.

Each of the frame components 12*a* through 12*d* includes cooperating tongue and groove assembly means, with the opposite frame members 12*a* and 12*c* having protruding tongues 32 extending from the ends thereof, and the other alternating frame members 12*b* and 12*d* being equipped with grooves 34 in the ends thereof; the grooves 34 may comprise the ends of the continuous channels 16. Assembly of the frame components 12 is accomplished by inserting the periphery 20 of the backing panel 14 into the cooperating channels and the tongues 32 of the frame sections 12*a* and 12*c* into the cooperating grooves 34 of the frame sections 12*b* and 12*d*. The tongues 32 may be adhesively secured within the grooves 34, in the manner of the adhesive means of securing the periphery 20 of the backing panel 14 within the frame channels 16, or alternatively secured therein (e.g., an interference fit between the tongues 32 and grooves 34 to secure the tongues tightly within the grooves, etc.). Further means of securing the frame components together, and alternative components, are discussed immediately following.

Figure 2:
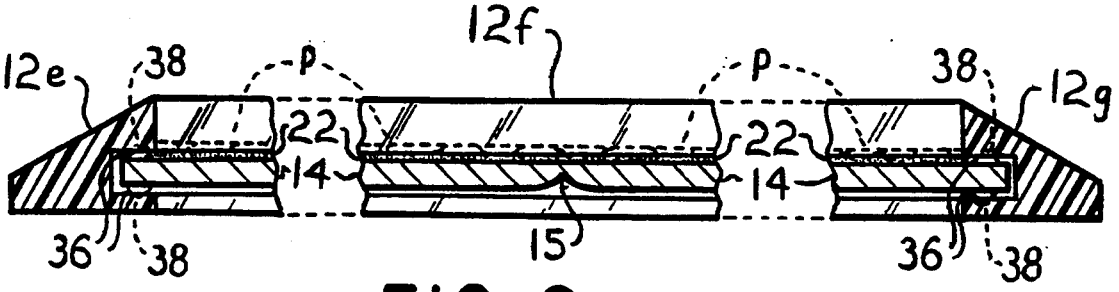
FIG. 2 is an elevation view in section of an assembled frame and backing panel, the frame being formed of a transparent material.

In FIG. 2, a cross sectional view of the assembled kit 10 of the present invention is shown. The frame components, designated 12*e* through 12*g* in FIG. 2, are formed of a transparent material (e.g., acrylic plastic, polycarbonate, glass, etc.), although it will be seen that non-transparent materials (translucent or opaque) may be used as desired. Each of the frame components 12*e* through 12*g* is preferably of like material and cross sectional shape; in the case of the frame components 12*e* through 12*g*, each will be seen to have a generally trapezoidal cross sectional shape, with an outwardly tapering bevel.

An alternative assembly means is disclosed in FIG. 2, wherein protrusions 36 may be provided within some of the frame components 12*e*–12*g* (or along the border of the backing panel 14) and cooperating depressions 38 provided in other frame components. The protrusions 36 and depressions 38 comprise snap fittings which will snap together to secure the assembly together, without need for additional adhesive or mechanical fastening means.

An assembled picture puzzle P is also shown in FIG. 2, having been assembled and adhesively secured to the adhesive coating 22 provided on the backing panel 14. The present kit 10 may be temporarily or permanently assembled as described above, and if a puzzle P is to be temporarily assembled and later disassembly is planned, then the adhesive overlay sheet 24 (or 24*a*) may be left in place to preclude the attachment of the puzzle pieces to the backing panel 14. However, if permanent assembly of the puzzle P is planned, then the overlay sheet 24 (or 24*a*) may be removed from the adhesive 22 (22*a*) and the puzzle pieces permanently assembled and adhered to the backing panel 14. The completed puzzle P, installed in the assembled kit 10, provides an attractive display.

Figure 3:
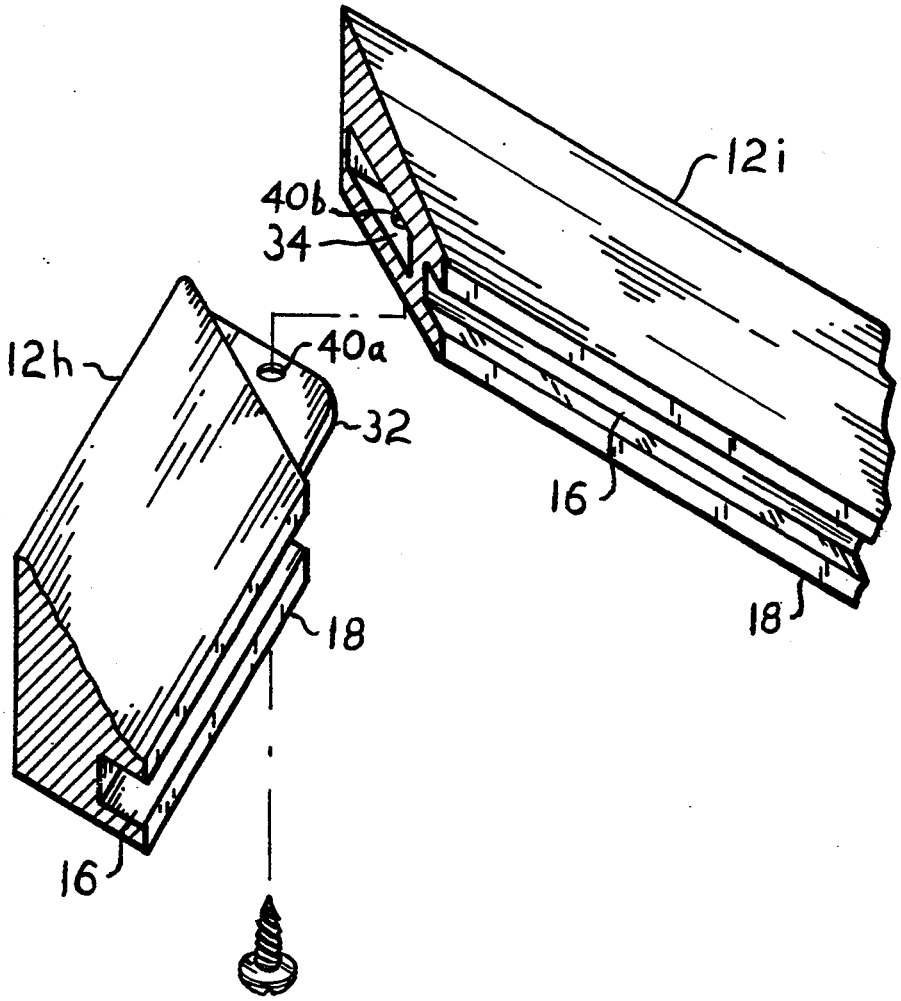
FIG. 3 is an exploded perspective view of a partial frame, showing a corner assembly and fastening means therefor.

FIG. 3 discloses yet another configuration of the present frame kit. In FIG. 3, only partial portions of two cooperating frame components, designated as 12*h* and 12*i*, are shown, it being understood that these components are essentially like those described above with the exception of the differences described immediately below. In FIG. 3, it will be seen that the frame components 12*h* and 12*i* are formed of opaque materials, which may be metal (e.g., polished or brushed aluminum or brass, etc.) or other suitable material. The cross sectional shape of the components 12*h* and 12*i* is somewhat different than those disclosed above, being a trapezoidal shape with an inwardly tapering bevel. The assembly means is similar to that described for the kit of FIG. 1, and comprises cooperating tongue 32 and groove 34 components. However, additional security may be provided for more sturdy or permanent assembly by means of cooperating holes 40*a* and 40*b* and screws 42. When the frame components 12*h* and 12*i* are assembled, the holes 40*a* and 40*b* will be concentric, whereupon tile screw(s) 42 may be threaded into the holes 40*a*/40*b* to secure the frame assembly together around a backing panel.

The above described kit and its various alternative forms may be used for the temporary or permanent assembly of a puzzle P therein. The kit provides for compact storage by means of the separable frame components and the foldable backing panel, and may be temporarily assembled for the temporary assembly of a puzzle P therein, by means of snap fittings, screws, interference fittings, etc. between components, or alternatively may be permanently assembled if desired. By removing the removable overlay protecting the adhesive coating over the majority of the backing panel, a puzzle may be permanently assembled in place on the backing panel and the assembled frame, panel and puzzle therein displayed, if desired. By separating the overlay material into central and border coverage, the border overlay may be retained or removed to provide for permanent adhesive assembly of the frame components onto the border of the backing panel, if desired. The provision of a score line separating the two overlays allows the central overlay sheet to be removed easily, even though the border of the panel is secured within the channels of the frame components. The frame may be formed of a number of different materials to provide various decorative completed frame assemblies, and the frame components may be provided in various sizes and shapes to closely fit an sizes and shapes of various completed picture puzzles. The present kit will be seen to be attractive to many persons who enjoy assembling picture puzzles and the like, and especially to those who wish to assemble such puzzles permanently for display.

It is to be understood that the present invention is not limited to the sole embodiment described above, but encompasses any and all embodiments within the scope of the following claims.

I claim:

1. A frame assembly kit for use in the assembly of picture puzzles, said kit comprising:

a plurality of frame components formed of like materials and cross sectional shapes and each having cooperating means providing for the assembly of said frame components with one another to provide a completed frame adapted for the assembly of a picture puzzle therein;

each of said frame components including an inner periphery having a continuous channel formed therein; and a backing panel having a periphery configured to fit within said channel of said each of said frame components;

said backing panel includes at least one side having an adhesive coating disposed at least partially thereover and at least one removable overlay sheet disposed over said adhesive coating;

said backing panel includes a central area comprising the majority of said backing panel and having a first removable overlay sheet disposed thereon, and further includes a border having a second removable sheet disposed thereon; whereby said second removable overlay sheet is separately removable from said first removable overlay sheet to expose said adhesive coating along said border of said backing panel without exposing said adhesive coating over said central area of said backing panel; whereby said frame components are assembled about said periphery of said backing panel with said channel of said each of said frame components fitting about said periphery of said backing panel and with said cooperating means providing for the assembly of said frame components with one another being used to provide a completed frame for the assembly of a picture puzzle therein.

2. The frame assembly kit of claim 1 wherein:
said cooperating means providing for the assembly of said frame components with one another to provide a completed frame comprises adhesive assembly means.

3. The frame assembly kit of claim 2 wherein:
said adhesive assembly means comprises said adhesive coating along said border of said backing panel providing for the adhesive securing of said backing panel within said channel of said each of said frame components.

4. The frame assembly kit of claim 1 wherein:
said backing panel includes a border which is devoid of said adhesive coating and said at least one removable overlay sheet.

5. The frame assembly kit of claim 4 wherein:
said channel of said each of said frame components includes a depth, and said border of said backing panel includes a width equal to said depth of said channel, whereby;
said adhesive coating and said at least one removable overlay sheet of said backing panel remain clear of said channel when said frame components are assembled about said backing panel to preclude the capture of said at least one removable overlay sheet within said channel and to provide for the ease of removal of said at least one removable overlay sheet from said backing panel.

6. The frame assembly of claim 1 wherein:
said cooperating means providing for the assembly of said frame components with one another to provide a completed frame comprise cooperating tongue and groove fittings.

7. The frame assembly of claim 6 wherein:
said cooperating tongue and groove fittings include screws.

8. The frame assembly of claim 1 wherein:
said cooperating means providing for the assembly of said frame components with one another to provide a completed frame include screws.

9. The frame assembly of claim 1 wherein:
said cooperating means providing for the assembly of said frame components with one another to provide a completed frame comprise snap fittings.

10. The frame assembly of claim 1 wherein:
said backing panel includes a crease substantially across the center thereof, with said crease providing for the folding of said backing panel for ease of storage thereof.

11. The frame assembly of claim 1 wherein:
said frame components are formed of wood.

12. The frame assembly of claim 1 wherein:
said frame components are formed of plastic.

13. The frame assembly of claim 12 wherein:
said plastic is transparent.

14. The frame assembly of claim 1 wherein:
said frame components are formed of metal.

15. The frame assembly of claim 1 wherein:
said frame components each include an inwardly beveled cross sectional shape.

16. The frame assembly of claim 1 wherein:
said frame components each include an outwardly beveled cross sectional shape.

17. The frame assembly of claim 1 wherein:
said frame components each have a substantially rectangular cross sectional shape.

* * * * *